United States Patent [19]

Kolt

[11] Patent Number: 4,697,736

[45] Date of Patent: Oct. 6, 1987

[54] AUTOMATIC DAMPER ASSEMBLY

[75] Inventor: Stanley Kolt, Mamaroneck, N.Y.

[73] Assignee: Leonard W. Suroff, Jericho, N.Y. ; a part interest

[21] Appl. No.: 843,769

[22] Filed: Mar. 25, 1986

Related U.S. Application Data

[63] Continuation of Ser. No. 689,092, Jan. 7, 1985, Pat. No. 4,582,250, which is a continuation of Ser. No. 500,074, Jun. 1, 1983, abandoned.

[51] Int. Cl.[4] ..... F24F 7/00

[52] U.S. Cl. ..... 236/49; 98/40.25; 251/212

[58] Field of Search ..... 98/72, 116, 42.09, 38.7, 98/38.8, 40.25; 236/49, 1 G, 93 R, 93 A; 251/298, 212; 137/601

[56] References Cited

U.S. PATENT DOCUMENTS

| | | | |
|---|---|---|---|
| 2,548,607 | 4/1951 | Jenn | 98/116 |
| 3,143,953 | 8/1964 | Bristol | 98/116 |
| 3,592,240 | 7/1971 | Hedrick | 251/212 X |
| 3,976,245 | 8/1976 | Cole | 137/601 X |
| 4,017,026 | 4/1977 | Felter | 137/601 X |
| 4,071,190 | 1/1978 | Ford, Jr. | 236/93 A |
| 4,123,001 | 10/1978 | Kolt | 98/72 |
| 4,193,541 | 3/1980 | Scheidweiler | 236/1.6 |

*Primary Examiner*—William E. Wayner
*Attorney, Agent, or Firm*—Leonard W. Suroff

[57] ABSTRACT

An automatic temperature responsive damper assembly for use within the conduit of a ventilating system designed to exhaust the air from a confined space to the atmosphere when the confined space reaches a preselected temperature greater than that in the conduit adjacent to the atmosphere includes at least one vane pivotally mounted within the conduit and preferably two. The vane or vanes are mounted so that they are movable between a generally opened position, wherein air can pass freely through the conduit, and a generally closed position, wherein air passage through the conduit is restricted. A temperature responsive drive assembly that detects the temperature of the air within the conduit is mounted therein and opens and closes the vanes. Biasing the vanes to a normally closed condition is accomplished by placing a greater portion of each vane beyond its pivotal axis and having the smaller portion of one vane cooperate with the larger portion of the other to maintain the generally closed position. Auxiliary biasing springs may also be utilized.

2 Claims, 11 Drawing Figures

AUTOMATIC DAMPER ASSEMBLY

This application is a continuation of application Ser. No. 689,092, filed Jan. 7, 1985, now U.S. Pat. No. 4,582,250, which was a continuation of application Ser. No. 500,074, filed June 1, 1983, now abandoned.

BACKGROUND OF THE INVENTION

1. Field of the Invention

The present invention relates to a ventilation conduit damper assembly and, more particularly, to a ventilation damper assembly provided with automatic temperature responsive actuating means which permits a greater amount of air flow therethrough when a preselected temperature is exceeded.

2. Description of the Relevant Art

Dampers for use in air conduits or ducts are generally well-known and typically include a movable vane or vanes which are positioned to control the amount of air flow through the conduit within which the damper is mounted. Dampers generally are used in conjunction with ventilating systems in private homes and other buildings where it is desired to provide a measure of ventilation control.

In some areas of the country, where unusually hot weather is experienced during a portion of the year, it is often desirable to provide a device for ventilating an otherwise confined portion of a building, e.g., the attic in a private home, in order to minimize the buildup therein of excess heat. This type of ventilation may be provided by a conventional turbine air ventilator wherein wind causes the turbine blades to rotate, creating a suction effect, thereby causing the air to flow out of the area provided with the ventilating conduit.

While turbine ventilation systems are quite effective in promoting air flow, they suffer from the lack of an effective automatic means to control the amount of air removed. Obviously, the air flow should be maximum during hot weather when the temperature of the air to be ventilated is high, and much less when the temperature in the air to be ventilated is lower. Unnecessary ventilation during periods of cool temperatures may cause excessive heat loss and increased heating costs. U.S. Pat. No. 4,123,011 issued to Stanley Kolt on Oct. 31, 1978 attempted to overcome these shortcomings. This device provides an automatic ventilator which permits ventilation during the heat buildup in a confined space, usually an attic. Similar ventilators are disclosed in U.S. Pat. Nos. 1,737,054; 3,921,900; 3,976,245 and 4,416,415.

The present invention overcomes the problems associated with the known art by providing an automatic temperature responsive damper for use in a ventilation system wherein the damper can control the amount of air flow in response to a preselected temperature.

An object of the present invention is to provide an automatic damper assembly for use in home and industrial ventilating systems.

Another object of the present invention is to provide an automatic damper which is reliable and maintenance-free.

Yet another object of the present invention is to provide an automatic damper assembly which has at least one vane damper positioned in an air flow conduit, the vane damper being automatically biased to a closed position when mounted in a vertical plane without the use of biasing springs.

A further object of the present invention is to provide an automatic vane damper assembly which automatically increases the air flow when subjected to a preselected temperature.

An additional object of the present invention is to provide an automatic damper assembly which can be readily adapted for use in a conventional conduit.

A still further additional object of the present invention is to provide an automatic damper assembly which can be used in conjunction with a wind driven turbine.

Still another object of the present invention is to provide an automatic damper assembly which is simple in design, inexpensive to manufacture, rugged in construction and efficient in operation.

The foregoing and other objects and advantages will appear from the description to follow. In the description reference is made to the accompanying drawing which forms a part hereof, and in which is shown by way of illustration a specific embodiment in which the invention may be practiced. This embodiment will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

SUMMARY OF THE INVENTION

An automatic temperature responsive damper assembly, according to the principles of the present invention, for use within the conduit of a ventilating system designed to exhaust air from a defined space into the atmosphere comprises a mounting apparatus for mounting of the damper assembly within the conduit; at least one vane rotatably mounted on the mounting assembly, the vane being rotatable between a normally closed position wherein the vane substantially reduces the passage of air flow through the conduit and an open position wherein the vane increases the air flow through the conduit. The vane is provided with a pivotal axis disposed transverse to the axis of the conduit and a surface area arranged to have a first portion thereof extend beyond one side of the pivotal axis for biasing the vane to a closed position and a second portion thereof extend beyond the other side of the pivotal axis. The second portion is adapted to cooperate with the first portion of a complementary vane to substantially reduce the air flow through the conduit. An air flow path is provided in the first vane portion for permitting a portion of the air to flow through the conduit when the vane is in the normally closed position. A device for rotating the vane to the open position when the temperature of the air in the defined space reaches a predetermined level is provided.

BRIEF DESCRIPTION OF THE DRAWINGS

Although the chracteristic features of the invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DESCRIPTION OF THE PREFERRED EMBODIMENTS

Figure 1:
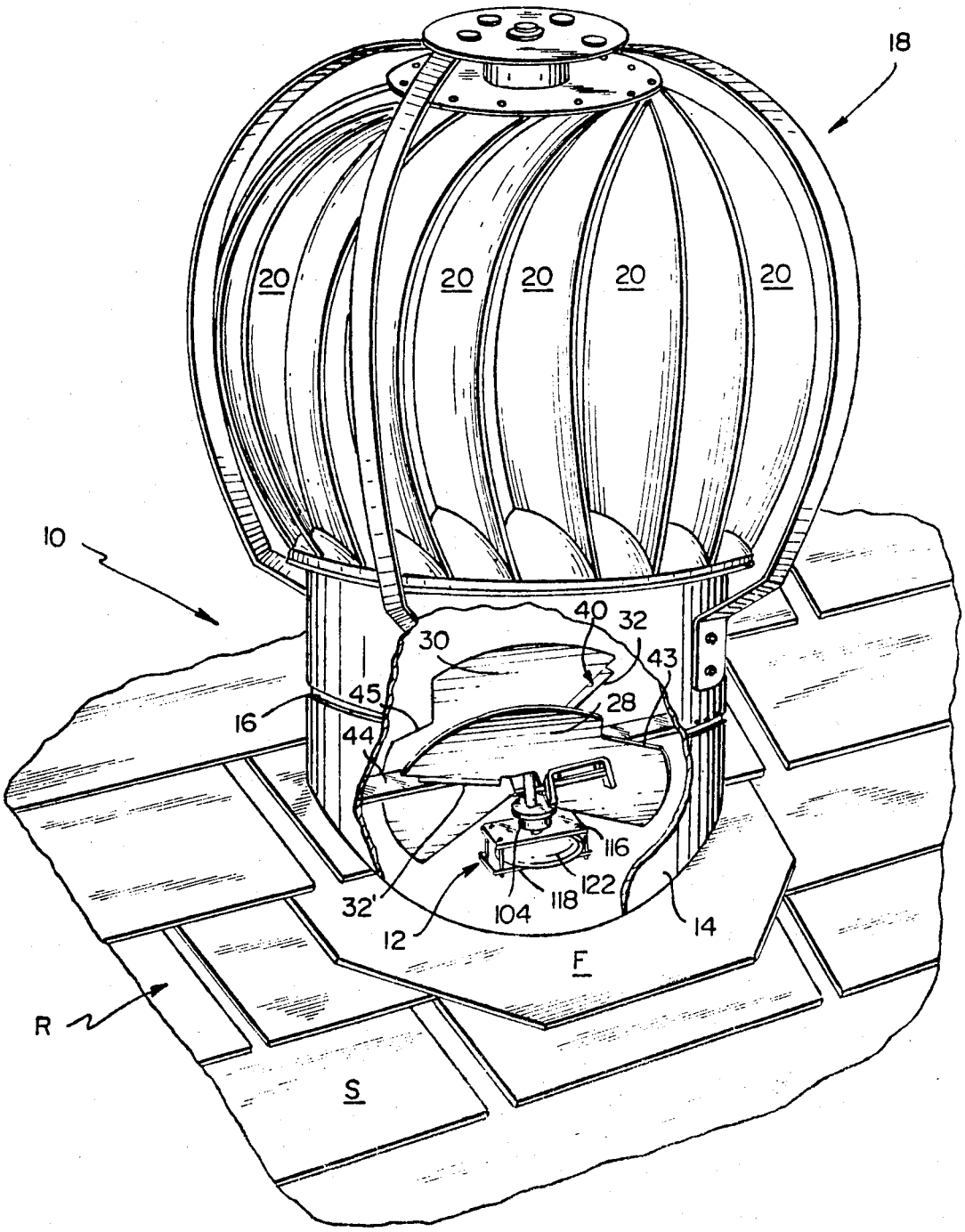
FIG. 1 is a perspective view of an automatic temperature responsive ventilation system, in accordance with the principles of the present invention.

Referring now to the figures, and more particularly, to FIG. 1, there is illustrated therein an automatic temperature responsive ventilation system 10 which incorporates a temperature responsive damper assembly 12. The ventilation system 10 may be mounted on a typical roof R by means of a conduit 14 suitably flashed by flashing F covering the shingles S of roof R adjacent to the conduit 14. At the upper end 16 of the conduit 14, there is mounted a wind driven turbine assembly 18. The wind driven turbine assembly 18 is of a conventional type and includes a plurality of wind catching blades 20.

Figure 4:
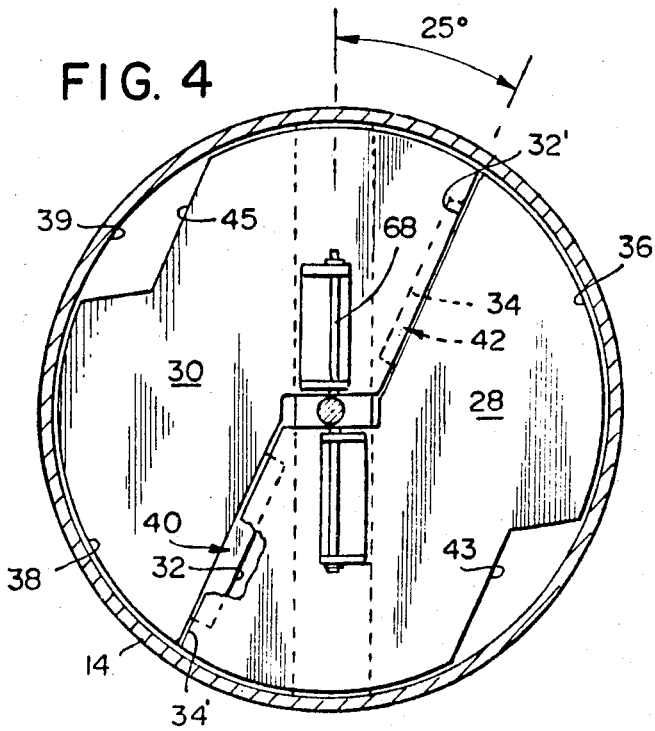
FIG. 4 is a cross-sectional view of the assembly of FIG. 2 taken substantially along the line 4—4.

Within the conduit 14, the damper assembly 12 includes a pair of vanes 28 and 30 each having, respectively, inner edges 32 and 32'; and 34 and 34' respectively, and outer edges 36 and 38. The outer edges 36 and 38 of the vanes 28 and 30 are in substantially conforming relationship to the inner circumference or curvature 39 of the conduit 14. In this manner, when the vanes 28 and 30 are in a closed position as illustrated in FIG. 4, there is a minimum spacing between the outer edges 36 and 38 and the inner circumference 39 of the conduit 14. In addition, sealing lips 40 and 42 are provided, respectively, to inner edges 32 and 34 of vanes 28 and 30, the sealing lips 40 and 42 contacting the inner edge of the adjacent vane to seal the space between the inner edges 32 and 34 thereof when in a closed position.

The vanes 28 and 30 may be fabricated from metal, plastic or the like and are additionally provided with notches or openings 43 and 45, respectively, to permit prescribed amounts of air flow when the vanes are in the closed position, thereby substantially reducing or completely eliminating flutter. The inner edges 32, 32', 34 and 34' are disposed at an angle of from 10 to 30 degrees, and preferably disposed at an angle of 25°, from the pivotal axis (shaft 68) and aid in the reduction of flutter also.

Figure 2:
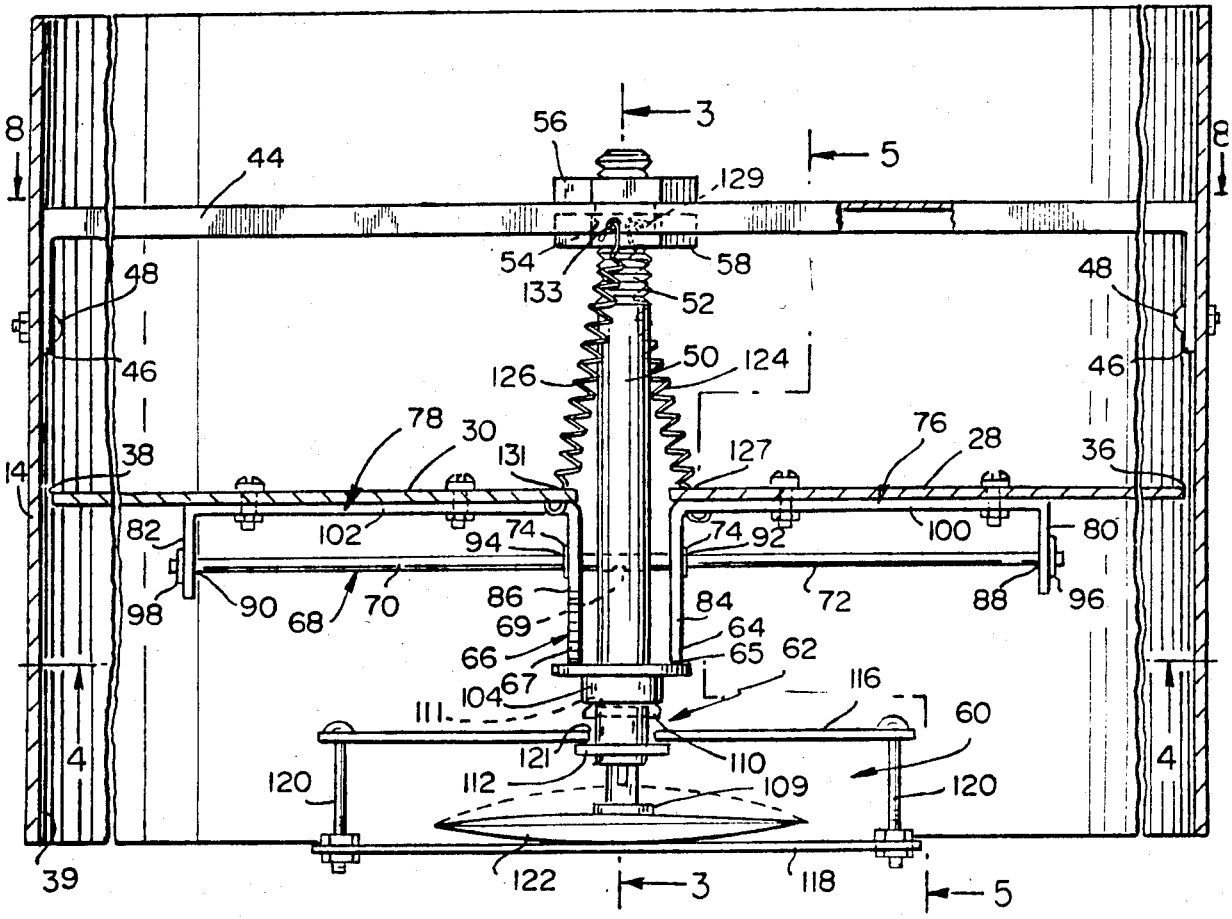
FIG. 2 is a fragmentary cross-sectional view of the ventilation system of FIG. 1.

In the U.S. Pat. No. (4,123,001) to Kolt the shape of the vanes are such that the inner edge extends in substantially parallel spaced relationship to each other with an outer edge substantially conforming with the inner circumference of the conduit. In this manner in the closed position of the vanes, as shown in FIG. 2, there will be a minimum of spacing therebetween to always permit a certain amount of air flow to take place. (Col. 4 lines 60 through 67). The air flow (leakage) occurring between the space between the vanes and the conduit causes annoying flutter of the vanes generating noise which resonates with the conduit and becomes annoying to anyone proximate the damper assembly.

Figure 3:
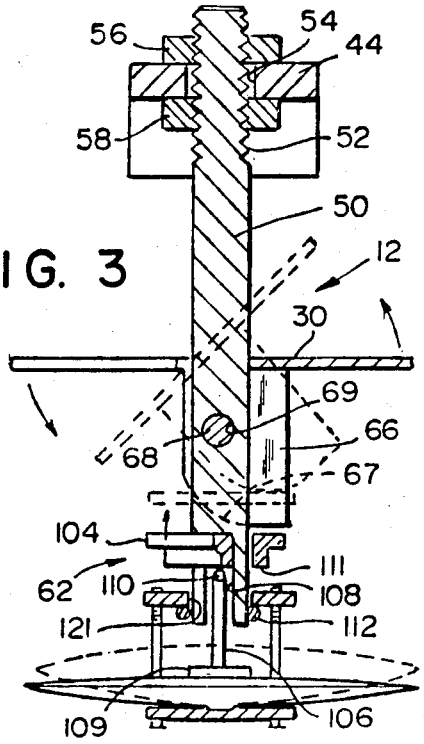
FIG. 3 is an enlarged cross-sectional view of the assembly of FIG. 2 taken substantially through the line 3—3.

With reference to FIG. 2, the manner in which the damper assembly 12 is mounted within the conduit 14 can be observed. The damper assembly 12 is secured to the conduit by a mounting bracket 44. The mounting bracket 44 includes flanges 46 at the distal ends thereof which are fixedly secured by fasteners 48 to the wall of the conduit 14. The fasteners 48 may be screws, rivets, or the like. Suspended from the mounting bracket 44 is a cylindrical housing 50 which includes a plurality of threads 52 proximate one end thereof. The mounting bracket 44 has an aperture 54 disposed therethrough, as illustrated in FIG. 3. Threads 52 extend through the aperture 54 and are engaged on either side of the mounting bracket 44 by a pair or nuts 56 and 58 which tightly clamp the mounting bracket 44 therebetween.

The cylindrical housing 50 serves to mount a temperature responsive assembly 60 at the other end thereof and also houses the transmission assembly 62, as hereinafter described, which transfers forces from the temperature responsive assembly 60 to the vanes 28 and 30 through camming members 64 and 66 associated, respectively, with vanes 28 and 30 as further described hereinafter.

A shaft 68, which functions as the pivotal axis of vanes 28 and 30, is disposed through an aperture 69 located in the cylindrical housing 50 as further illustrated in FIG. 3. The housing effectively divides the shaft 68 into a first section 70 and a second section 72. The shaft 68 is retained in position relative to the cylindrical housing 50 by a pair or retaining washers 74 which each frictionally engage the shaft 68.

The vanes 28 and 30 are mounted to the shaft sections 70 and 72 by a pair of U-shaped bracket members 76 and 78, associated, respectively, with the vanes 28 and 30. The bracket members 76 and 78 are provided at the distal ends thereof, respectively, upstanding substantially perpendicular ears 80 and 82 and 84 and 86. The ears 80, 82, 84 and 86 have disposed therethrough, respectively, apertures 88, 90, 92 and 94. The section 70 extends through the apertures 88 and 92 and the shaft section 72 extends through the apertures 82 and 86, the apertures 88, 90, 92 and 94 are dimensioned to permit the journaling of the bracket members 76 and 78 with respect to the shaft 60. The bracket member 76 is retained on the shaft section 70 by locking washer 96 and the bracket member 78 is retained on the shaft section 72 by a locking washer 98.

Figure 5:
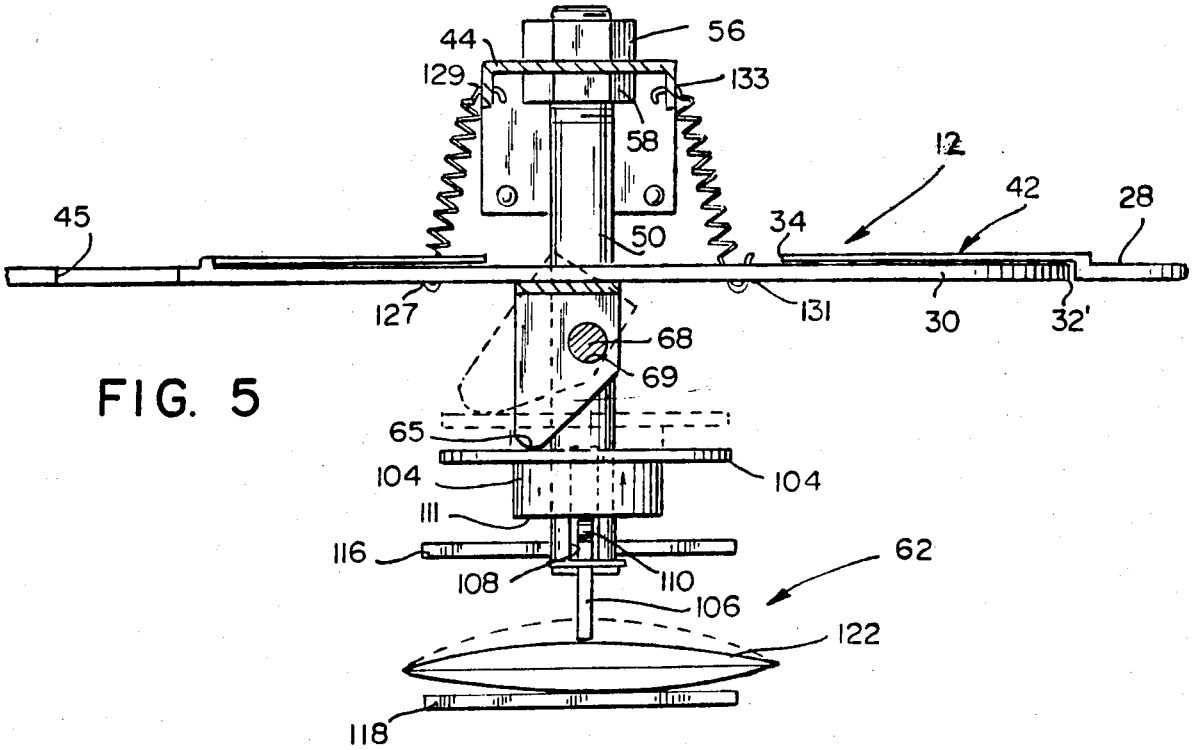
FIG. 5 is an enlarged cross-sectional view of the assembly of FIG. 2 showing the vanes in their open and closed positions.
Figure 6:
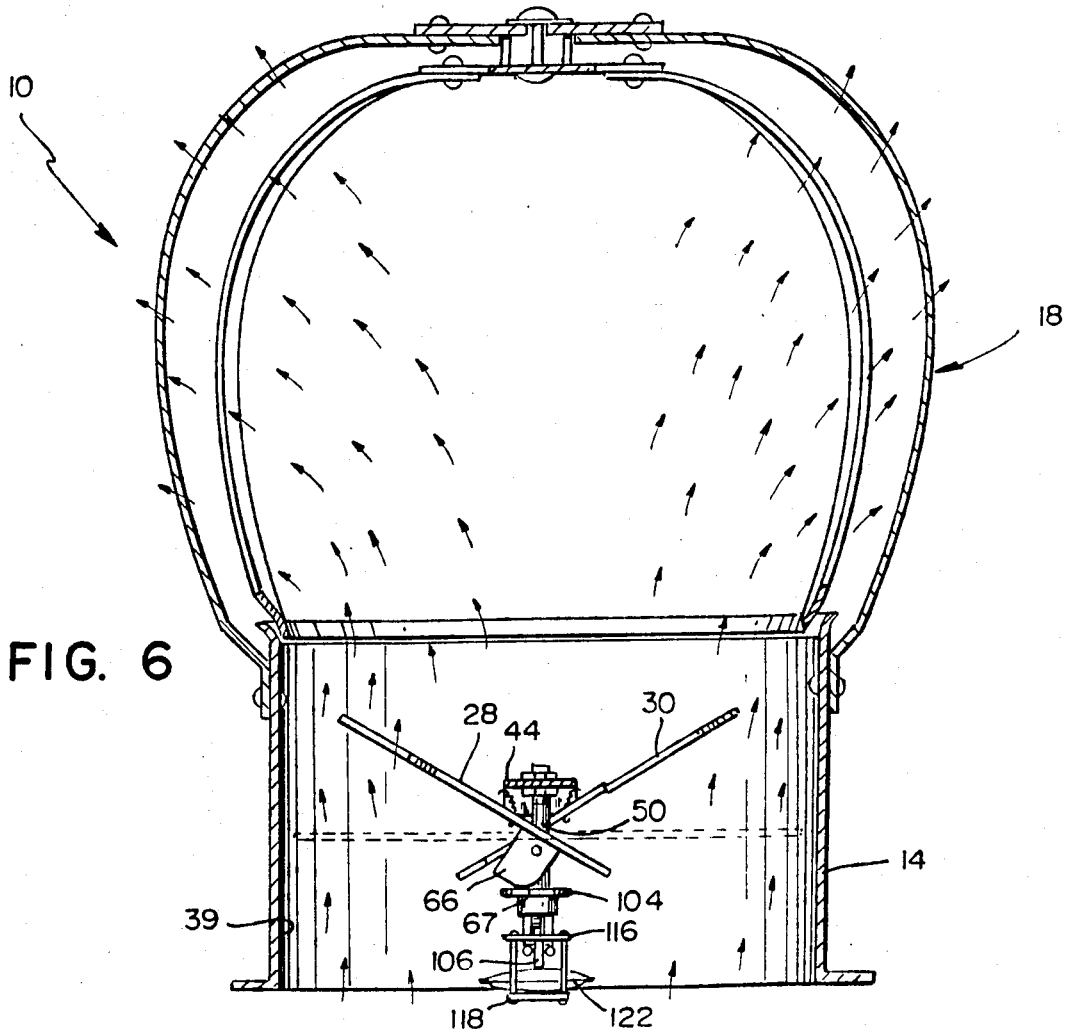
FIG. 6 is a cross-sectional view in elevation of the embodiment of FIG. 1.

The body of the bracket members 76 and 78 include, respectively, base portion 100 and 102 each fixedly secured, respectively, to the vanes 28 and 30. The ears 84 and 86 incorporate, respectively, the camming surfaces 65 and 67. As a result, when force is placed on these camming surfaces by the reciprocating collar member 104, an element of the transmission means 62, the vanes 28 and 30 are pivoted from a closed to an open position as illustrated in FIGS. 1, 3, 5 and 6. The camming surfaces 65 and 67 are rounded on their ends as illustrated in FIGS. 5 and 6 and are inclined at opposing angles with respect to each other to cause the vanes 28 and 30 to open in opposite directions as illustrated.

The balance of the transmission assembly 62 includes a reciprocating member 106 which reciprocates coaxially in a hollow slotted portion of channel 108 of the cylindrical housing 50 and which includes a disc shaped head 109. The reciprocating member 106 also includes a pair of protrusions 110 which extend outwardly from the hollow slotted portion 108 and which contact the lowermost edge 111 of the reciprocating collar 104. The reciprocating member 106 is retained within the hollow portion 108 of the cylindrical housing 50 by a retaining pin or C-ring 112 which frictionally engages the cylindrical housing 50. When pressure is placed on the disc-shaped head 109 of the reciprocating member 106, it transfers such force through the protrusions 110 to the reciprocating collar 104 which in turn places force on the camming surfaces 64 and 66, opening the vanes 28 and 30. The opening of vane 30 is illustrated in phantom in FIG. 3 and the opening of vane 28 is illustrated in phantom in FIG. 5.

With reference to FIGS. 2 and 3, the temperature responsive assembly 60 can be seen to comprise a top plate 116 and a bottom plate 118 separated by a plurality of posts 120. The posts 120 may be variously configured and serve merely to keep the top plate 116 and the bottom plate 118 in a spaced-apart relationship. The end of the cylindrical housing 50 extends through an aperture 121 in the top plate 116, the retaining ring 112 retains the top plate 116 on the housing 50. Disposed between the top plate 116 and the bottom plate 118 is a sealed bellows power drive unit 122. The sealed bellows power drive unit 122 serves as a thermal power source which, in conjunction with the balance of the structure of the temperature responsive assembly 60 provides the necessary force, under thermal influence, to open the vanes 28 and 30.

The sealed bellows power drive unit 122 is of a conventional design and is filled with a heat expansible fluid, the volatility of which is matched along with the shell thickness, type of metal and volume of the unit, to provide a suitable expansion at the desired temperature range. In addition to being actuated at the appropriate design temperature, the power drive unit 122 of the present invention must also be capable of generating a force in the range of about 50 to 60 pounds per square inch in order to operate the damper vanes 28 and 30. It will be understood that any one of a number of temperature sensitive power drive units may be utilized in the temperature responsive assembly 60 as long as their expansion and contraction charateristics are predictable and the force generated is suitable over the desired temperature range.

Accordingly, the bellows power drive unit 122 is capable of expanding and contracting in response to temperature changes between predetermined limits and to generate a force upon expansion. Expansion of the unit 122 is illustrated in phantom in FIGS. 2 and 3. The bellows power drive unit 122 is fixedly secured to the bottom plate 118 so that the opposite end thereof can exert a force upon the reciprocating member 106 at the rounded end 109 thereof. The end 109 is in contact with the power drive unit 122.

Figure 8:
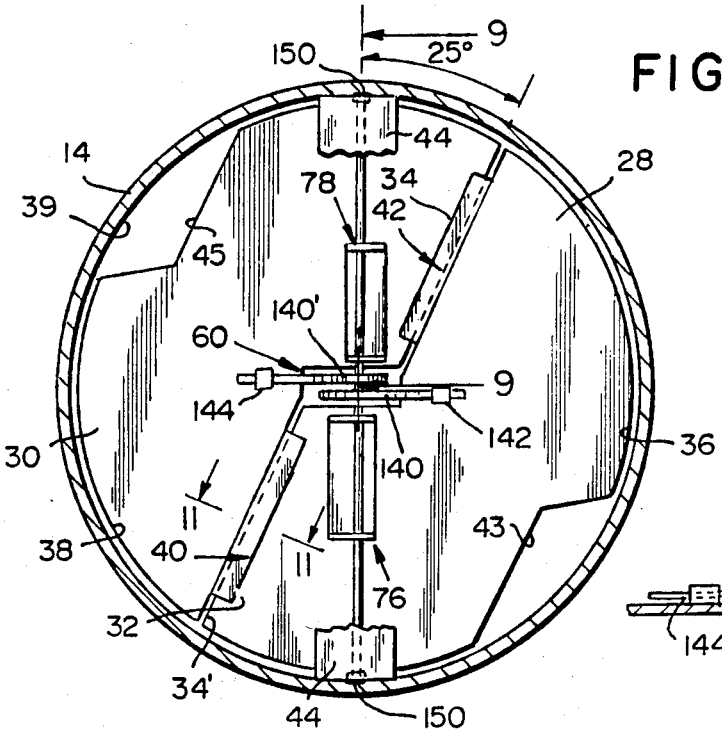
FIG. 8 is a cross-sectional view taken substantially along the line 8—8 of FIG. 2 showing an alternative embodiment of the temperature responsive drive assembly.
Figure 10:
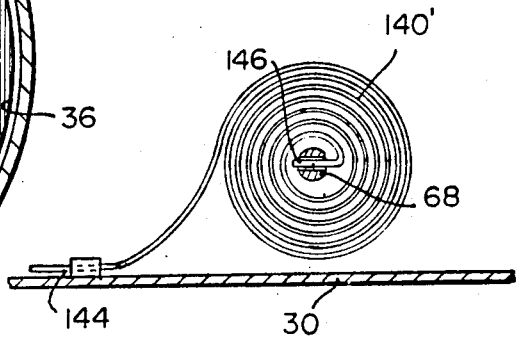
FIG. 10 is an end view elevation taken along the line 10—10 of FIG. 9.
Figure 9:
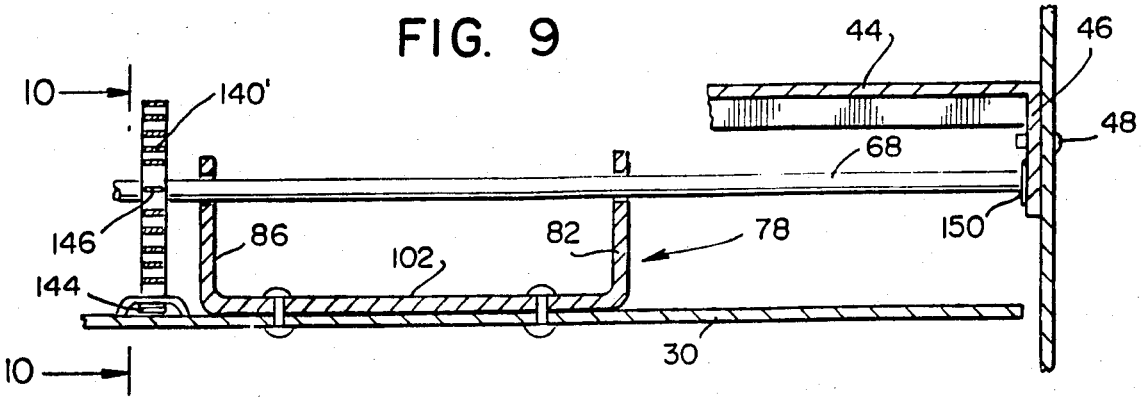
FIG. 9 is an enlarged cross-sectional view taken along the line 9—9 of FIG. 8.

To provide auxiliary biasing to the camming surfaces 64 and 66 in contact with the reciprocating collar 104, a pair of helical tension springs 124 and 126 are provided. The spring 124 is fixedly secured on one end thereof to a protrusion or slot 127 provided on vane 28 and on the other end thereof to a tab 129 provided the mounting bracket 44. Similarly, the spring 126 is fixedly secured to one end thereof to a protrusion or slot 131 provided on vane 30 and on the other end thereof secured to a tab 133 provided on mounting bracket 44. Helical tension springs 124 and 126 apply a pulling or auxiliary biasing force respectively on the vanes 28 and 30, in a manner which causes them to rate towards a rest or closed position as illustrated in FIGS. 2 and 4. The force provided by the springs 124 and 126 acts upon the vanes 28 and 30 in a manner which causes them to rotate about their pivotal axis or shaft 68, as a result of the point of attachment of the springs 124 and 126. It is further to be noted that vanes 28 and 30, into which notches 43 and 45, respectively are cut, are larger in size and disposed on one side of pivotal axis 69 while the smaller portions of vanes 28 and 30 are disposed on the other side of pivotal axis 68 (see FIGS. 4 and 8).

Figure 7:
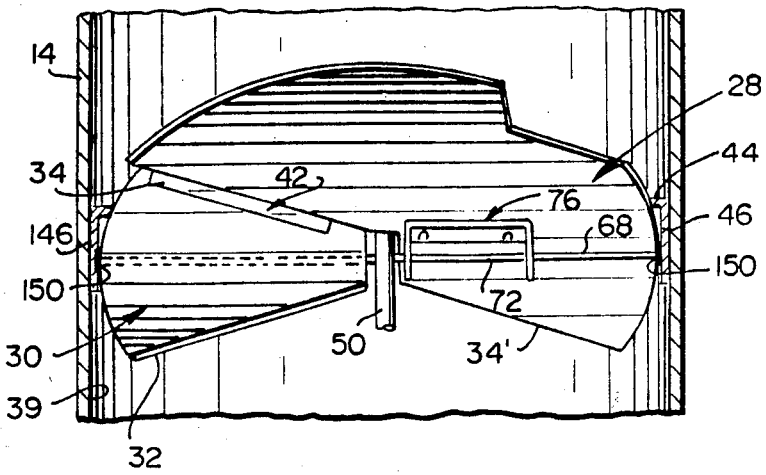
FIG. 7 is a perspective view of a pair of vanes.

Referring to FIG. 6, the present invention can be seen in cross-section or in FIG. 7 it may be seen isometrically illustrating the vanes 28 and 30 in an open position provided when the temperature of the drive unit 122 has been exceeded.

Figure 11:
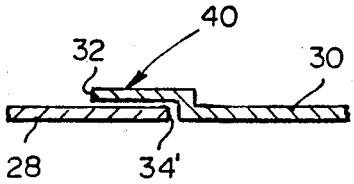
FIG. 11 is an enlarged cross-sectional view taken along the line 11—11 of FIG. 8.

The temperature responsive assembly 60 in the alternative embodiment disclosed in FIGS. 8–11 is fabricated from a bi-metallic flat or linear coil 140 in lieu of the gaseous thermostat disclosed hereinbefore. Coils 140 and 140′ have one end 142 and 144 connected directly to each of the vanes 28 and 30, respectively, with their other ends 146 and 148, respectively, affixed to the pivotal axis or shaft 68 (FIGS. 9 and 10) which extends to and is fixed in apertures 150 provided in flanges 46 of mounting bracket 44 and transmit the necessary force to open the vanes 28 and 30 at a predetermined temperature as discussed above. In this embodiment the camming means and biasing means are not utilized and apertures 88, 90, 92 and 94 are larger than the diameter of shaft 68 thereby permitting vanes 28 and 30 to freely rotate. FIG. 11 is an enlarged view of the edge portions 32 and 34′ of the vanes 28 and 30 showing their interlocking method.

Although illustrative embodiments of the invention have been described in detail herein with reference to the accompanying drawings, it is to be understood that the invention is not limited to these precise embodiments, and that various changes and modifications may be effected therein without departing from the scope or spirit of the invention.

Having thus set forth the nature of the invention, what is claimed is:

1. An automatic temperature responsive damper assembly for use within the conduit of a ventilating system designed to exhaust air from a defined space into the atmosphere comprising:

(a) mounting means for mounting said damper assembly within said conduit;

(b) at least one vane rotatably mounted on said mounting means, said vane being rotatable between a normally closed position wherein said vane substantially reduces the passage of air flow through said conduit and an open position wherein said vane increases the air flow through said conduit, said vane having;

(i) a pivotal axis disposed transverse to the axis of said condut, (ii) a surface area including a larger first portion and a smaller second portion, said larger first portion extending beyond one side of said pivotal axis for biasing said vane to a closed position, said second portion extending beyond the other side of said pivotal axis, said second portion being adapted to cooperate with a first portion of a complementary vane to substantially reduce the air flow through said conduit, (iii) an air flow path provided in said first vane portion for permitting a prescribed amount of said air to flow through said conduit when said vane is in said normally closed position, and (iv) said vane first portion and said vane second portion being provided with inner edges and an outer edge, said inner edges being disposed at an angle from said pivotal axis of between 10 and 30 degrees, said outer edge substantially conforming to the shape of said conduit except for an opening through which said prescribed amount of air flows; and (c) means for rotating said vane towards said open position when the temperature of the air in said defined space reaches a predetermined level.

2. An automatic temperature responsive damper assembly according to claim 1, wherein said angle is essentially 25 degrees.

* * * * *